US007677547B2

(12) United States Patent
de Haan

(10) Patent No.: US 7,677,547 B2
(45) Date of Patent: Mar. 16, 2010

(54) APPARATUS AND METHOD FOR SEPARATING FLAT ITEMS FROM STACKS

(75) Inventor: Hendrik Andries de Haan, Bergum (NL)

(73) Assignee: NEOPOST Technologies, Bagneux (FR)

( * ) Notice: Subject to any disclaimer, the term of this patent is extended or adjusted under 35 U.S.C. 154(b) by 204 days.

(21) Appl. No.: 11/617,429

(22) Filed: Dec. 28, 2006

(65) Prior Publication Data

US 2007/0152395 A1 Jul. 5, 2007

(30) Foreign Application Priority Data

Dec. 30, 2005 (EP) ..... 05078047

(51) Int. Cl.
*B65H 3/44* (2006.01)

(52) U.S. Cl. ..... 271/9.01; 271/9.12; 271/149; 271/150

(58) Field of Classification Search ..... 271/9.12, 271/149, 150, 145, 9.01, 9.04
See application file for complete search history.

(56) References Cited

FOREIGN PATENT DOCUMENTS

JP 56023139 A * 4/1981 ..... 271/9.12

* cited by examiner

*Primary Examiner*—David H Bollinger
(74) *Attorney, Agent, or Firm*—Sughrue Mion, PLLC

(57) ABSTRACT

A holder of an apparatus for individually separating flat items from stacks comprises a first separating structure for individually separating outer flat items from one of the stacks at one end of the holder and a second separating structure for individually separating outer flat items from another stack at the opposite end of the holder. At least one urging member is at least partially positioned between the two separating structures for urging at least one of the stacks in the holder towards one end of the holder. A method for separating flat items from two stacks in a holder is also described.

10 Claims, 3 Drawing Sheets

APPARATUS AND METHOD FOR SEPARATING FLAT ITEMS FROM STACKS

CROSS-REFERENCE TO RELATED APPLICATIONS

This application claims priority from European Patent Application No. EP 05078047.7 filed Dec. 30, 2005.

TECHNICAL FIELD AND BACKGROUND ART

The invention relates to an apparatus and to a method for individually separating flat items, such as flat items from stacks.

Apparatus and methods for individually separating flat items from stacks are known from practice in many varieties and can for instance be found in copiers, printers and inserter systems for preparing items to be mailed.

In particular in large apparatuses, many feeders are often provided for individually feeding sheets and/or envelopes of a wide variety of types. The numbers of different types of sheets or other components that are required and the thicknesses of the components often vary from job to job. A substantial portion of the capacity of the holders into which the stacks of the flat items to be fed are positioned is often not used, whereas the holders occupy space and require an accordingly large housing structure.

SUMMARY OF THE INVENTION

It is an object of the invention to provide a solution that allows better use of the holder space in an apparatus and a method for individually separating flat items from stacks.

According to the invention, this object is achieved by providing an apparatus for individually separating flat items from stacks, including:

a holder for holding at least two stacks of flat items, a first one of the stacks having an outer item in a first separating position and a second one of the stacks having an outer item in a second separating position, the first and second separating positions being situated at opposite ends of the holder;

a first separating structure for individually separating outer flat items from the first one of the stacks at the first separating position;

a second separating structure for individually separating outer flat items from the second one of the stacks at the second separating position; and at least one urging member at least partially positioned between the two separating structures for urging at least one of the stacks in the holder between the urging member and one of the separating positions towards the one of the separating positions.

The invention may also be embodied in a method for individually separating flat items from stacks, including:

holding at least two stacks, a first one of the stacks having an outer item in a first separating position and a second one of the stacks shaving an outer item in a second separating position, the first and second separating positions being situated at ends of the stacks facing away from each other;

urging at least a first one of the stacks towards the first separating position;

individually separating outer flat items of the first one of the stacks from the first separating position; and individually separating outer flat items of a second one of the stacks from the second separating position.

Because items can be separated from two stacks at ends of the stacks facing away from each other, the holder space can be fully used by two stacks of different sizes, for instance in accordance with the numbers and thicknesses of the items to be fed from the two stacks during a given operating period. Furthermore, it is possible to place or to ad items to a stack during separation of items from the other stack at one of the separating positions and to subsequently switch to separating items at the other one of the separating positions from the stack that has been placed last or to which items have been added last. If the items of the first stack are identical to, or at least suitable as a replacement of, the items of the second stack, refilling can thus be carried out during operation.

Further aspects, effects and details of the invention are set forth in the detailed description with reference to examples of embodiments of the invention.

DETAILED DESCRIPTION

Figure 1:
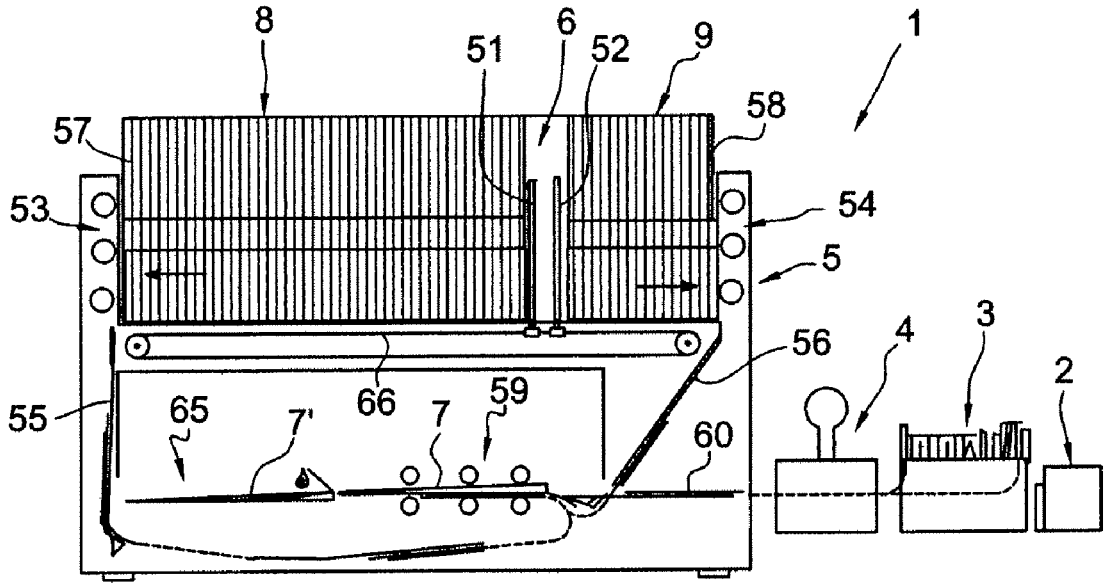
FIG. 1 is a schematic, cut-away, side elevational view of a first example of an inserting system including two examples of apparatuses according to the invention, one being shown enlarged and in more detail than the other stations of that system.
Figure 2:
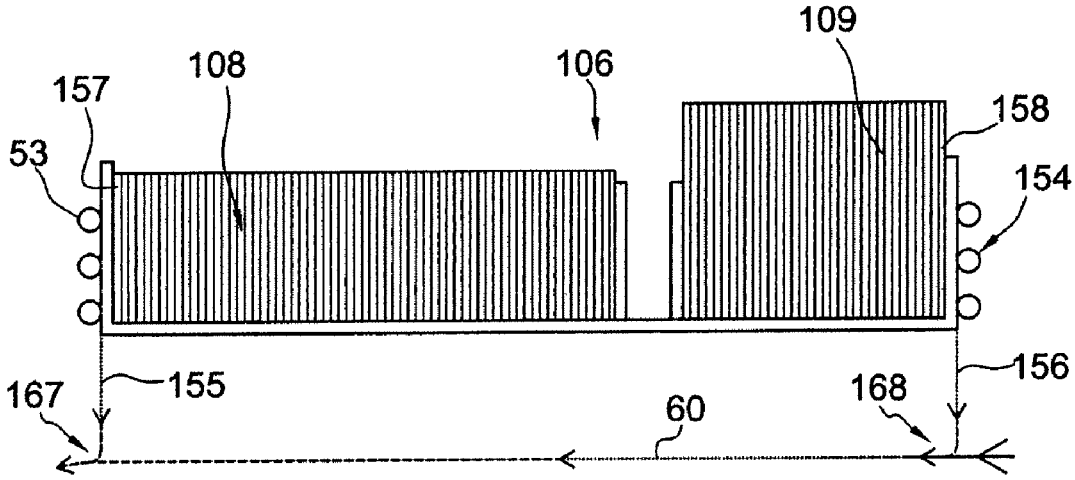
FIG. 2 is schematic, cut-away, side elevational view of the holder and feeding tracks of one of the apparatuses according to the invention shown in FIG. 1.

In FIGS. 1-3, an inserting system 1 is shown that is composed of a printer 2, an insert feeding station 3 for adding inserts to documents received from the printer 2, a folding station 4 for folding documents and inserts received from the insert feeding station and an inserter station 5 for inserting documents and inserts received from the folding station 4.

The inserter station 5 is a first example of an apparatus according to the invention. The insert feeding station 3 is a second example of an apparatus according to the invention and is shown in more detail in FIGS. 2 and 3A-3D.

The inserter station 5 has a holder in the form of an envelope hopper 6, for holding a first stack 8 of envelopes and a second stack 9 of envelopes. At opposite ends of the holder 6, first and second separating units 53, 54 are situated for each time individually feeding an outermost envelope from the respective one of the stacks 8, 9. The outermost envelopes of the first and second stacks are each time held in first and, respectively, a second separating position 57, 58 at opposite ends of the holder 6. The separated envelopes are individually fed into a first and, respectively, a second transport track 55, 56.

In the present example, the stacks are oriented with the stacked envelopes extending in vertical planes, the stacking direction being horizontal. Thus, the term stack also encompasses for instance a row of mutually contacting flat items positioned on edge on a support.

Under the envelope hopper 6, an envelope-stuffing holder 59 is located. The first and second transport tracks 55, 56 lead to the envelope filling holder 59 which is arranged for receiving envelopes 7 one by one and for holding each envelope 7 in a position for inserting items to be mailed arriving from the folding station 4 via a main transport track 60. The envelope filling holder 59 is further arranged for passing on filled envelopes 7 to a moistening and sealing station 65 from where the envelopes 7' can be transported via a transport track (not shown) to an exit (not shown) in a direction perpendicular to the plane of drawing.

Between the separating units 53, 54, first and second urging members 51, 52 are arranged. The first urging member 51 is displaceable towards the first separating unit 53 to urge the stack 8 towards that separating unit 53. The second urging member 52 is displaceable towards the second separating unit 54 to urge the stack 9 towards that separating unit 54. For driving displacement of the urging members, the urging members are each connected to one of a pair of belts 66 and controllable to move each of the belts 66 individually and separately of the other one of the belts 66.

Thus, the envelope hopper 6 has separating units 53, 54 at opposite ends for separating and feeding envelopes from the first and second stacks 8, 9 into first and, respectively, second transport tracks 55, 56 leading to the envelope filling holder 59.

Because two stacks 8, 9 of envelopes can be positioned in the same holder 6, it is possible to supply two different types of envelopes from the same holder or the full holder capacity may be used to supply envelopes of the same type. Moreover, if envelopes of the same type are fed from opposite ends of the holder 6, during feeding from one of the stacks 8, 9, a new other stack 9, 8 may be placed in the holder 6, or at least a stack of envelopes may be added to the other stack. Thus, stocking up of the holder 6 may be carried out during automatic and continuous operation of the inserter station 5.

The first urging member 51 is displaceable away from the separating position 57 to a position closer to the other separating position 58, so that the first stack 8 may occupy more than half, and preferably 90% or more, of the space of the holder 6 between the separating units 53, 54. Preferably, the second urging member 52 is displaceable away from the second separating position 58 over a similar distance, so that both stacks 8, 9 can be of a large size, provided the other stack 9, 8 is of a size leaving sufficient space. Thus, it is possible to use the full capacity of the holder with stacks 8, 9 of different sizes. This, in turn, allows accommodating to differences in the thicknesses of the different types of envelopes and differences between the anticipated numbers of envelopes of the two types that are to be fed.

If, instead of two urging members as shown in the present example, a single urging member is provided that is selectively displaceable in opposite directions for urging the first stack towards the first separating position when displacing in a first one of the directions and for urging the second stack towards the second separating position when displacing in a second one of the directions, the space within the holder that is occupied by the urging facilities may be reduced.

As shown in FIGS. 2 and 3, the holder 106 of the insert feeding station 3, is also equipped with separating units 153, 154 at opposite ends of the holder 106 and with two transport tracks 155, 156 connecting to the separating units, for transporting items separated and fed by the separating units from separating positions 157 and, respectively 158. In FIG. 2, the items in the stacks 108, 109 in the holder 106 are stacks of two types of inserts. The transport tracks 155, 156 merge at two merging locations 167, 168 with the main transport track 60, so that inserts can be added to documents arriving from the printer 2 at the merging locations 167, 168. It is also possible to feed the inserts from the stacks 108 and/or 109 as the only items that are to be inserted at the envelope-stuffing holder 59.

Since, in combination with the main transport track 60, inserts can be fed via the first and the second transport tracks 155, 156 to the same location 59, items that need to be gathered can be fed from the two ends of the holder 106.

Since the first and the second transport tracks 155, 156 also lead to different positions 167, 168, in this example along the main transport track 60, it is also possible to simultaneously supply items separated and fed from the first and second stacks as contributions to different compositions of mail sets in preparation.

Figure 3A:
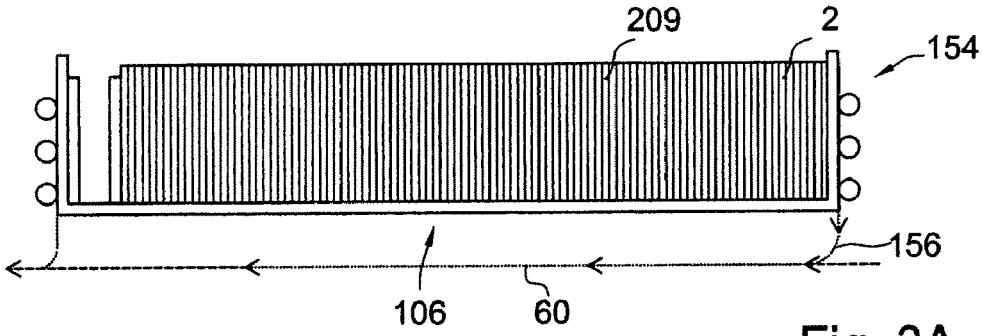
FIGS. 3A-3D are schematic, side views of the apparatus according to FIG. 2 in a series of operating situations.
Figure 3B:
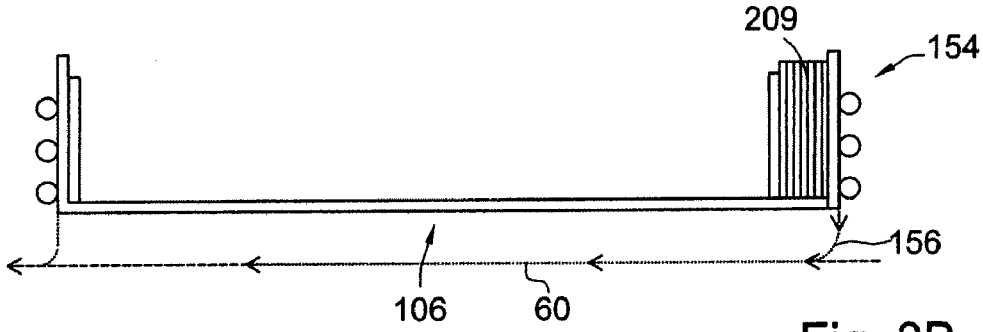
Figure 3C:
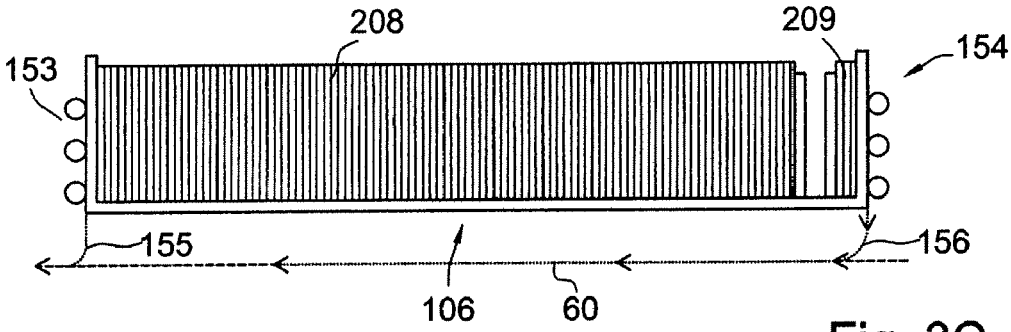
Figure 3D:
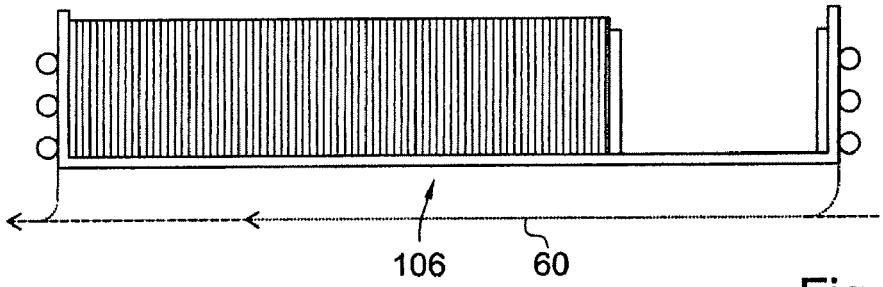

In FIG. 3A the holder 106 initially contains only a second stack 209 and initially inserts are separated by the second separating unit 154 from the second stack 209 only and supplied to the main transport track 60 via the second transport track 156. This is continued, until the situation shown in FIG. 3B has been reached in which almost all inserts of the second stack 209 have been separated and fed. While the separation and feeding of items from the second stack 209 is continued, a new stack 208 is positioned in the holder 106 so that a situation as shown in FIG. 3C is reached. The new stack 208 may be regarded as a new first stack or as the third stack. When all inserts from the old stack 209 have been fed, the separation and feeding of inserts by the second separating unit 154 is stopped and the separating and feeding of inserts from the new stack 208 by the first separating unit 153 is started. A stage of operation in that situation is generally shown in FIG. 3D. The start of the separation and feeding by the first separating unit 153 is timed in relation to the stop of the separation and feeding by the first separating unit 153, that the first insert from the new stack is added to the first mail set in preparation to which no insert from the old stack 209 has been added. The inserts may for instance be cards, sheets, folded sheets or (return) envelopes.

Figure 4:
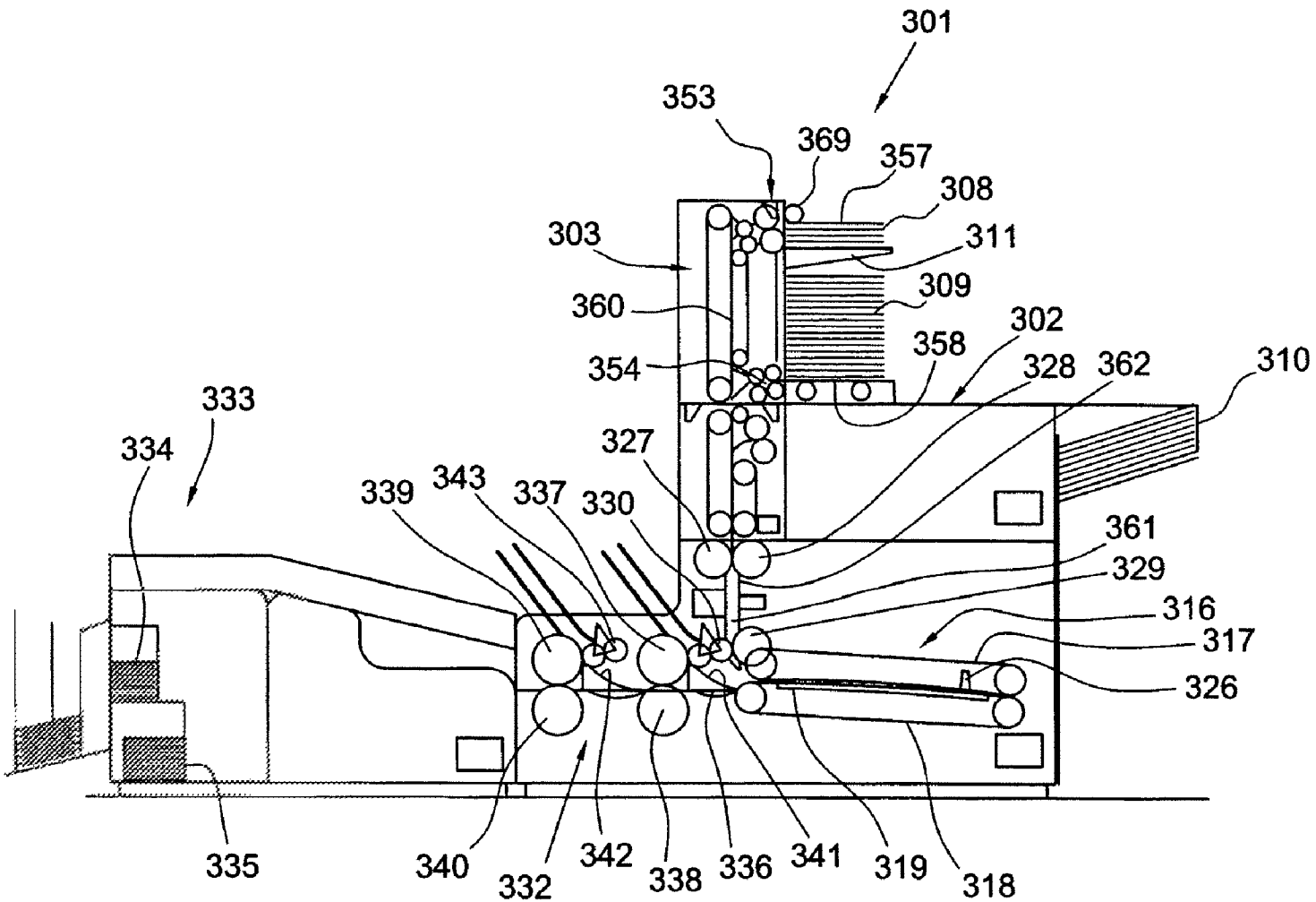
FIG. 4 is a schematic, cut-away, side elevational view of a second example of an inserting system including a third example of an apparatus according to the invention.

In FIG. 4, an example of an apparatus 303 according to the invention is shown, in which the stacks 308, 309 are stacked in a vertical direction. The apparatus is part of a mail preparation system 301 equipped with a printer 302 and a delivery station 303 for delivering documents.

The delivery station 303 is equipped with an urging member 311 in the form of a platform for urging a stack 308 towards a separating position 357 against a supply roller 369 of a first separating unit 353. The holder is in this example formed by the urging member 311, the platform of the separating unit 354 on which the second stack 309 rests and a sidewall of a housing through which main transport track 360 extends. Both stacks 308, 308 are stacked with one side of the stack against that wall. An example of a separating device suitable for use in a feeder according to the exemplary embodiment shown is described in more detail in applicants' international patent application NL 91/00023, to which reference is being made here.

At the bottom end of the delivery station 303, a second separating unit in the form of a bottom separating unit 354 is arranged for separating flat items from the bottom end of a stack 309. The first and second separating units 353 and 354 are arranged for separating and feeding sheets to the main transport track 360, which is formed by a series of opposite belts and rollers.

Because the stack 309 is already urged towards a separating position 358 where items are separated and fed by the second separating unit 354 by gravity, only a single urging member 311 is necessary for urging the first stack 308 towards the first separating position 357. The printer 302 has a container 310 for the sheets to be printed.

The system further comprises an aligning station 316 for aligning documents belonging to a given set to a stack having on one side substantially aligned document edges. The aligning station 316 is designed as a head station having a supply track, an aligning surface 319 with a displaceable stop 326 and a discharge track 336 in alignment with the aligning surface 319. The supply track is formed by transport rollers

327, 328, 329, 330 and guides 361, 362 and the aligning surface 319 is formed by a portion of a conveyor belt 318 passing over a support.

The documents arriving via the supply track can be transported in the direction of supply to a position abutting the stop 326 and then be discharged in the opposite direction. The aligned document edges then form the trailing edge of the stack. In the station 332 the place of each fold is determined relative to the trailing edge of the stack of documents. The stop 326 is attached to the conveyor belt 318 and can be displaced by running the conveyor belt 318.

Arranged opposite the aligning surface 319 are pressing belts 317 which are displaceable in the direction of the stop 326 approximately parallel to the aligning surface 319, apply pressure to the aligning surface 319 and have a greater coefficient of friction to paper than does the aligning surface 319. By displacing the pressing belts 317 in the direction of the stop 326, documents present between the aligning surface 319 and the pressing belts 317 can be pressed against the stop 326 so that the document edges on the side of the stop 326 are aligned relative to each other.

The folding station 32 has a first and a second pair of folding rollers 337, 338 and 339, 340, with the discharge track 336 extending between the folding rollers 337, 338 and 339, 340. Between the stop 326 and the folding rollers 337, 338 and 339, 340, deflectors 341 and 342 are arranged for deflecting the edge of a stack that faces away from the stop 326. Opposite one of each pair of folding rollers, a pressing roller 330, 343 is located for pressing a deflected portion of a set of documents against a circumferential surface of the folding roller 337, 339, respectively.

After alignment of a set of documents, the set of documents is first displaced counter to the direction of supply and then moved to the folding station 332 by shifting the stop 326. The edge of the set remote from the stop 326 and a contiguous portion of the set are deflected along a pair of folding rollers 337, 338 or 339, 340 and are clamped against the proximal folding roller 337 or 339 of this pair of folding rollers 337, 338 or 339, 340, whereafter the folding rollers are driven so that the deflected portion of the stack is bent further and is brought between the folding rollers, where a fold is made in the set.

A folding station and a folding method of the type as described above is described in more detail in applicants' European patent 0 421 547, to which reference is being made here.

An inserter station 333 connects to the folding station 332. This envelope station 333 is equipped with two containers 334, 335 for envelopes. As a base for such an envelope station 333, for instance applicant's "in2" can be used.

From the foregoing, it will be clear to the skilled person, that within the framework of invention as set forth in the claims also many variations other than the examples described above are conceivable. For instance, the transport track connecting to one of the separating units may lead to an envelope filling position for holding envelopes to be filled and the other separating unit may connect to a transport track leading to the envelope filling position for inserting items fed along that transport track in the envelope in that envelope filling position. This configuration allows, for example, to use the hopper space for stacks of envelopes and postal items to be inserted therein, while the heights of the stacks may be in widely varying proportions relative to each other, for instance in accordance with the relative thicknesses of the envelopes and of the items to be inserted therein.

What is claimed is:

1. An apparatus for individually separating flat items from stacks, comprising:

a holder for holding at least two stacks of flat items, a first one of the stacks having an outer item in a first separating position and a second one of the stacks having an outer item in a second separating position, the first and second separating positions being situated at opposite ends of the holder;

a first separating structure for individually separating topmost flat items from the first one of the stacks at the first separating position;

a second separating structure located lower than the first separating structure, including a platform for supporting the second stack, and arranged for individually separating lowermost flat items from the second one of the stacks at the second separating position; and a single urging member at least partially positioned between the two separating structures and constituting a platform for supporting the first stack in the holder and for urging the first stack in the holder between the urging member and the first separating position towards the first separating position.

2. An apparatus according to claim 1, further for individually transporting separated flat items, further comprising a first transport track connecting to the first separating structure for transporting flat items received from the first separating structure and a second transport track connecting to the second separating structure for transporting flat items received from the second separating structure, the first and second transport tracks leading towards a common position.

3. An apparatus according claim 1, further for individually transporting separated flat items, further comprising a first transport track connecting to the first separating structure for transporting flat items received from the first separating structure and a second transport track connecting to the second separating structure for transporting flat items received from the second separating structure, the first transport track leading to a first position and the second transport track leading to a second position different from the first position.

4. An apparatus according to claim 1, wherein the urging member for urging a stack towards one of the separating positions is displaceable away from said separating position to a position closer to the other one of the separating positions, for accommodating a stack occupying at least more than half of the size in stacking direction of the holder between the separating positions, between the urging member and said one of the separating positions.

5. An apparatus according to claim 1, wherein the urging member for urging a stack towards one of the separating positions is displaceable away from said separating position to a position closer to the other one of the separating positions, for accommodating a stack occupying at least nine tenth of the length of the holder between the separating positions between the urging member and said one of the separating positions.

6. An apparatus for individually separating flat items from stacks, comprising:

a holder for holding at least two stacks of flat items, a first one of the stacks having an outer item in a first separating position and a second one of the stacks having an outer item in a second separating position, the first and second separating positions being situated at opposite ends of the holder;

a first separating structure for individually separating outer flat items from the first one of the stacks at the first separating position;

a second separating structure for individually separating outer flat items from the second one of the stacks at the second separating position; and at least one urging member at least partially positioned between the two separating structures for urging at least one of the stacks in the holder between the urging member and one of the separating positions towards said one of the separating positions;

wherein the urging member is selectively displaceable in opposite directions for urging the first one of the stacks towards the first separating position when displacing in a first one of said directions and for urging the second one of the stacks towards the second separating position when displacing in a second one of said directions.

7. An apparatus according to claim 6, further for individually transporting separated flat items, further comprising a first transport track connecting to the first separating structure for transporting flat items received from the first separating structure and a second transport track connecting to the second separating structure for transporting flat items received from the second separating structure, the first and second transport tracks leading towards a common position.

8. An apparatus according claim 6, further for individually transporting separated flat items, further comprising a first transport track connecting to the first separating structure for transporting flat items received from the first separating structure and a second transport track connecting to the second separating structure for transporting flat items received from the second separating structure, the first transport track leading to a first position and the second transport track leading to a second position different from the first position.

9. An apparatus according to claim 6, wherein the urging member for urging a stack towards one of the separating positions is displaceable away from said separating position to a position closer to the other one of the separating positions, for accommodating a stack occupying at least more than half of the size in stacking direction of the holder between the separating positions, between the urging member and said one of the separating positions.

10. An apparatus according to claim 6, wherein the urging member for urging a stack towards one of the separating positions is displaceable away from said separating position to a position closer to the other one of the separating positions, for accommodating a stack occupying at least nine tenth of the length of the holder between the separating positions between the urging member and said one of the separating positions.

* * * * *